US006036293A

United States Patent [19]

Anell et al.

[11] Patent Number: 6,036,293

[45] Date of Patent: Mar. 14, 2000

[54] REFRIGERATOR CABINET AND METHOD OF ASSEMBLING THE SAME

[75] Inventors: Thomas Carl Anell, Knoxville; Edward Everett Crompton, III, Galesburg; Kenneth Davis, Berwyn; Charles R. Horton, Galesburg; Sheldon Wayne Mandel, East Galesburg; Gerald L. Wolanin, Galesburg, all of Ill.

[73] Assignee: Maytag Corporation, Newton, Iowa

[21] Appl. No.: 09/145,990

[22] Filed: Sep. 3, 1998

[51] Int. Cl.[7] ..... A47B 96/04

[52] U.S. Cl. ..... 312/406; 312/257.1; 312/407; 312/401

[58] Field of Search ..... 312/400, 401, 312/404, 406, 406.2, 407, 408, 116, 257.1

[56] References Cited

U.S. PATENT DOCUMENTS

| | | | |
|---|---|---|---|
| 2,426,055 | 8/1947 | Rundell . | |
| 2,579,396 | 12/1951 | Philipp . | |
| 2,675,687 | 4/1954 | Philipp . | |
| 2,845,320 | 7/1958 | Saunders et al. | 312/406.2 X |
| 2,869,952 | 1/1959 | Saunders | 312/406.2 X |
| 2,958,210 | 11/1960 | Rill, Jr. . | |
| 2,997,353 | 8/1961 | Horvay | 312/406.2 |
| 4,580,852 | 4/1986 | Smitte et al. . | |
| 4,606,112 | 8/1986 | Jenkins et al. | 312/406.2 X |
| 4,632,470 | 12/1986 | Jenkins et al. . | |
| 4,735,062 | 4/1988 | Woolley et al. | 312/407 X |
| 4,958,890 | 9/1990 | Anderson et al. | 312/406.2 |
| 4,974,914 | 12/1990 | Jenkins . | |
| 5,897,181 | 4/1999 | Avendano et al. | 312/406.2 X |

FOREIGN PATENT DOCUMENTS

| | | | |
|---|---|---|---|
| 1061618 | 4/1954 | France | 312/406.2 |
| 1275744 | 5/1972 | United Kingdom | 312/406.2 |

*Primary Examiner*—Peter M. Cuomo
*Assistant Examiner*—Hanh V. Tran
*Attorney, Agent, or Firm*—Everett G. Diedericks, Jr.

[57] ABSTRACT

A refrigerator cabinet assembly includes a cabinet shell having opposed side walls that are interconnected by a top wall and a shell bottom. Each of the side and top walls of the shell lead to front face portions which are integrally formed with return flanges for use in mounting one or more liners within the cabinet shell in a manner known in the art. In accordance with the preferred embodiment, the shell bottom is spaced rearwardly of the return flanges such that a receiving slot is defined therebetween. The cabinet assembly further includes an integrated, structural reinforcing frame mounted within the cabinet shell by sliding the frame within the receiving slot and securing the frame to the return flanges. After mounting a yoder tube, a mullion bar and the liners within the cabinet shell, a plastic toe plate is attached to the reinforcing frame. The toe plate is provided with side flanges which extend about the side walls of the cabinet shell. The reinforcing frame is provided, prior to positioning within the cabinet shell, with various attachment structure enabling door hinges, cabinet levelers and wheel assemblies to be readily secured to the overall cabinet assembly. In addition, gaps are created between side portions of the reinforcing frame and the cabinet shell to enable foam insulation to flow therebetween to further increase the overall structural integrity and thermal performance of the cabinet.

19 Claims, 4 Drawing Sheets

5
33
30
17
23
-28-
34
44
38
22
-14-
32
36
25
31
37
41
35
56
50
58
52
-13-
-47-
2
43
39
51
16
54
118
9
125
49
120
24
117
128
118
121
7
76
124
122
127
68
65
75
72
89
88
98
87
69
99
73
95
97
79
64
86
103
105
96
100
85
102
84
81
100
77
78

REFRIGERATOR CABINET AND METHOD OF ASSEMBLING THE SAME

BACKGROUND OF THE INVENTION

1. Field of the Invention

The present invention pertains to the art of refrigerators and, more particularly, to a refrigerator cabinet assembly including a cabinet shell that is structurally reinforced by an integrated frame unit.

2. Discussion of the Prior Art

In constructing a refrigerator cabinet, it is highly desirable to minimize the weight of the cabinet shell to reduce manufacturing, transportation and additional associated costs, yet it is imperative that the cabinet be structurally sound in order to counteract loads exerted thereon without deforming. Mainly due to cost efficiencies and flexibility in workmanship, it has been commonplace to utilize sheet metal in the forming of most refrigerator cabinets on the market today. Since the sheet metal is thin and rather high loads are often placed on the shell, particularly by the opening and closing of a weighted down refrigerator door, a fair amount of effort has been applied in this art to provide reinforcement for such a refrigerator cabinet. Of course, an additional important concern is the ease of assembly of the cabinet as a whole.

With this in mind, it has heretofore been proposed to form the sides and top of a refrigerator cabinet shell out of a single piece of bent sheet metal and then attach thereto rear and bottom walls. Thereafter, the shell is structurally reinforced in an attempt to avoid deformation during use. Such known reinforcing arrangements generally take the form of providing multiple reinforcement members, in the form of bars or plates, and securing these members to the cabinet individually. An example of such a known arrangement is represented by U.S. Pat. No. 4,632,470.

A major drawback of such a known arrangement is the difficulties associated with assembling the cabinet, including the manner of insertion and the aligning of the various reinforcement members. More specifically, various holes are provided in both the cabinet shell and the reinforcement members which must be maintained in alignment both during and after the attachment of each of the reinforcement members to the cabinet shell. As these holes are sometimes quite small, maintaining this alignment can be quite burdensome. This problem becomes even more apparent when more than two sets of holes must be aligned as is the case with some of the structural reinforcement members presented in the above-identified '470 patent. Furthermore, mounting these reinforcement members individually is time consuming. Various other reinforcing arrangements have also been proposed in this art in an attempt to enhance the structural stability of refrigerator cabinets and to simplify the assembly process. However, there still exists a need in the art of refrigerators for a cabinet having enhanced structural and efficient assembly characteristics, while also being cost effective, as well as aesthetically pleasing.

SUMMARY OF THE INVENTION

The cabinet assembly of the invention includes a shell that is formed by opposed, upright side walls which are spaced and interconnected by a top wall. Both the top and side walls have forwardmost portions which are bent to define front face and return flange portions of the cabinet. The return flanges define cavities which are adapted to receive one or more liners therein. The cabinet also preferably includes a shell bottom that interconnects the side walls. A frontal portion of the shell bottom is positioned rearward of the return flanges such that a receiving slot is defined therebetween. Within this receiving slot is slidably received an integrated, structural reinforcing frame. The structural reinforcing frame includes a pair of side reinforcing members that are interconnected by spaced cross members. In accordance with the preferred embodiment, the reinforcing frame is provided with various attachment structure enabling a toe plate, door hinges, cabinet levelers and wheel assemblies to be readily secured to the overall cabinet assembly.

Once the reinforcing frame is positioned within the cabinet shell, it is secured to the return flanges. Following the positioning of a yoder tube, a mullion and cabinet liners in the shell, a plastic toe plate is attached to the assembly. In the most preferred form of the invention, the toe plate includes side flanges that extend around the side walls of the shell to enhance the aesthetics of the cabinet. Furthermore, the toe plate is secured to the reinforcing frame by door hinge structure.

With this arrangement, the gauge of the material used to form the cabinet shell can be minimized, while still increasing the structural integrity of the overall refrigerator cabinet assembly. Since the reinforcing frame and the cabinet shell are completely individual assemblies and can be simply united by sliding the frame into the cabinet shell through an appropriate relief created at the shell bottom, the overall assembly of the refrigerator cabinet is simple and economical. Further economies are realized since the frame is preformed, prior to insertion into the cabinet shell, with structure enabling the toe plate, upper door hinges, cabinet leveler legs and front roller wheel assemblies to be readily mounted thereto.

Additional features and advantages of the present invention will become more readily apparent from the following detailed description of a preferred embodiment thereof when taken in conjunction with the drawings where like reference numerals refer to corresponding parts in the several views.

BRIEF DESCRIPTION OF THE DRAWINGS

FIG. 2*a* is an enlarged detailed view of a joint associated with a reinforcing frame incorporated in the refrigerator cabinet assembly of FIG. 1;

FIG. 2*b* is a side view of an upper portion of the reinforcing frame of FIG. 2*a;*

DETAILED DESCRIPTION OF THE PREFERRED EMBODIMENT

Figure 1:
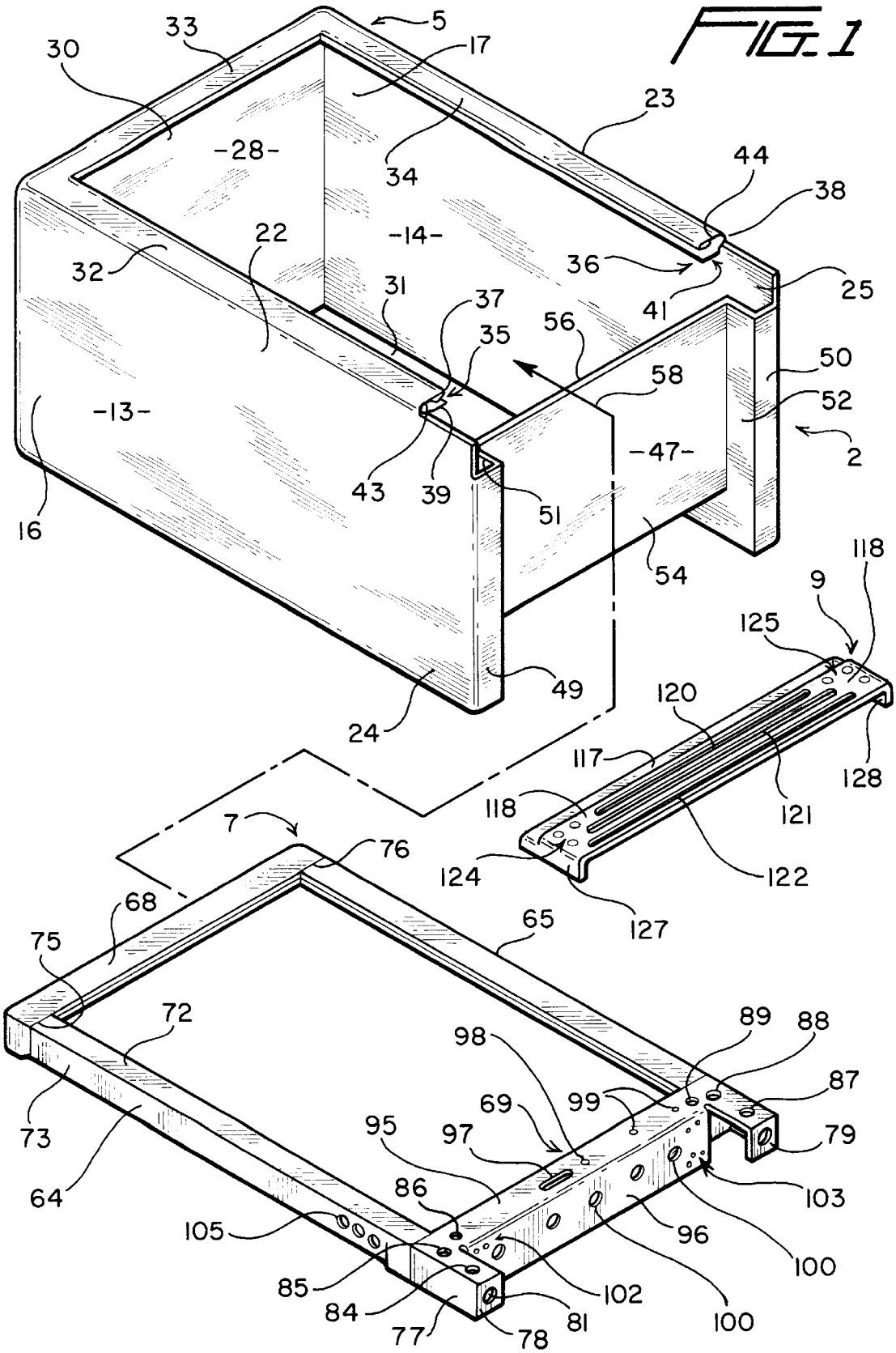
FIG. 1 is an exploded view of a refrigerator cabinet assembly constructed in accordance with the present invention.

With initial reference to FIG. 1, the refrigerator cabinet of the present invention is generally indicated at 2. Refrigerator cabinet 2 includes a cabinet shell 5, a reinforcing frame unit 7 and a toe plate 9. Although the particular materials utilized to form the elements of refrigerator cabinet 2 may vary in accordance with the invention, in the preferred embodiment, cabinet shell 5 is preferably made from 0.017 inch gauge sheet metal, reinforcing frame unit 7 is made from 0.089 inch gauge steel and toe plate 9 is formed of plastic. As clearly shown in this figure, cabinet shell 5 includes a pair of laterally spaced side walls 13 and 14. Side walls 13 and 14 include upper end portions 16 and 17, forwardmost portions 22 and 23 and lowermost portions 24 and 25 respectively.

Cabinet shell 5 also includes a top wall 28 having a forwardmost portion 30, as well as a rear wall 31 that is secured to side walls 13 and 14 and top wall 28 by any means known in the art including crimping and welding. Each of side walls 13, 14 and top wall 28 are formed from a single sheet and preferably bent so as to define front face portions 32–34. In addition, front face portions 32–34 are further bent, preferably through a roll-forming process, to define in-turned return flanges such as those indicated at 35 and 36. In general, each front face portion 32–34 has an inner curved section 37 that leads to an outer curved section 38 and an inner layer 39 of the respective return flange 35, 36. With this construction, each return flange 35, 36 defines a liner receiving cavity generally indicated at 41. Although the particular construction of return flanges 35 and 36 will be more fully discussed below, at this point, it should be noted that front face portions 32 and 34, as well as return flanges 35 and 36, have respective terminal ends 43 and 44.

Cabinet shell 5 is further provided with a shell bottom 47 which, in the preferred embodiment, includes a pair of spaced, generally horizontal leg defining sections 49 and 50 that are either integrally formed with or secured to side walls 13 and 14 by any means known in the art such as welding or crimping. Each horizontal leg defining section 49 and 50 leads to a respective upstanding section 51, 52. Upstanding sections 51 and 52 are interconnected by a horizontal central section 54. As also clearly shown in this figure, shell bottom 47 includes a front edge 56 that is recessed rearwardly relatively to the forwardmost portions 22 and 23 of side walls 13 and 14, as well as return flanges 35 and 36. Due to the manner in which shell bottom 47 is recessed, a receiving slot, indicated by arrow 58, is defined within cabinet shell 5 between front edge 56 and return flanges 35 and 36.

Reinforcing frame unit 7 includes a pair of laterally spaced side reinforcing members 64 and 65 that are interconnected by upper and lower cross members 68 and 69. Side reinforcing members 64 and 65, as well as upper and lower cross members 68 and 69, are preferably, generally L-shaped in cross-section. For instance, each side reinforcing member 64 is generally constituted by a front plate 72 and a side plate 73. As also shown in FIGS. 2*a* and 2*b*, each side reinforcing member 64, 65 abuts upper cross member 68 along a respective joint 75, 76. In the preferred embodiment, side reinforcing members 64 and 65 and upper cross member 68 are formed as separate elements from pre-cut galvanized steel brackets. Thereafter, joints 75 and 76 are welded along both front and side plates 72 and 73 for superior structural integrity. Although preferably formed separate, it should be understood that side reinforcing members 64 and 65 could be formed integral with upper cross member 68 by bending a continuous member such that, for example, only welds at front plates 72 are required.

Referring back to FIG. 1, each lateral end portion of lower cross member 69 generally defines a leg 77 which terminates in a lower support member 78 and 79 respectively. Each support member 78, 79 is formed with an aperture 81 that is preferably threaded. Each threaded aperture 81 is adapted to receive a threaded leg leveler (not shown) which is generally constituted by a threaded rod having a foot member attached thereto such that the refrigerator cabinet 2 can be easily leveled when placed on an uneven support surface in a manner known in the art. As also shown in FIG. 1, the lateral end portions of lower reinforcing member 69 are also provided with spaced, generally triangularly arranged sets of through holes 84–86 and 87–89. Although not clearly shown in this figure, each through hole 84–89 is also preferably, internally threaded.

Figure 5A:
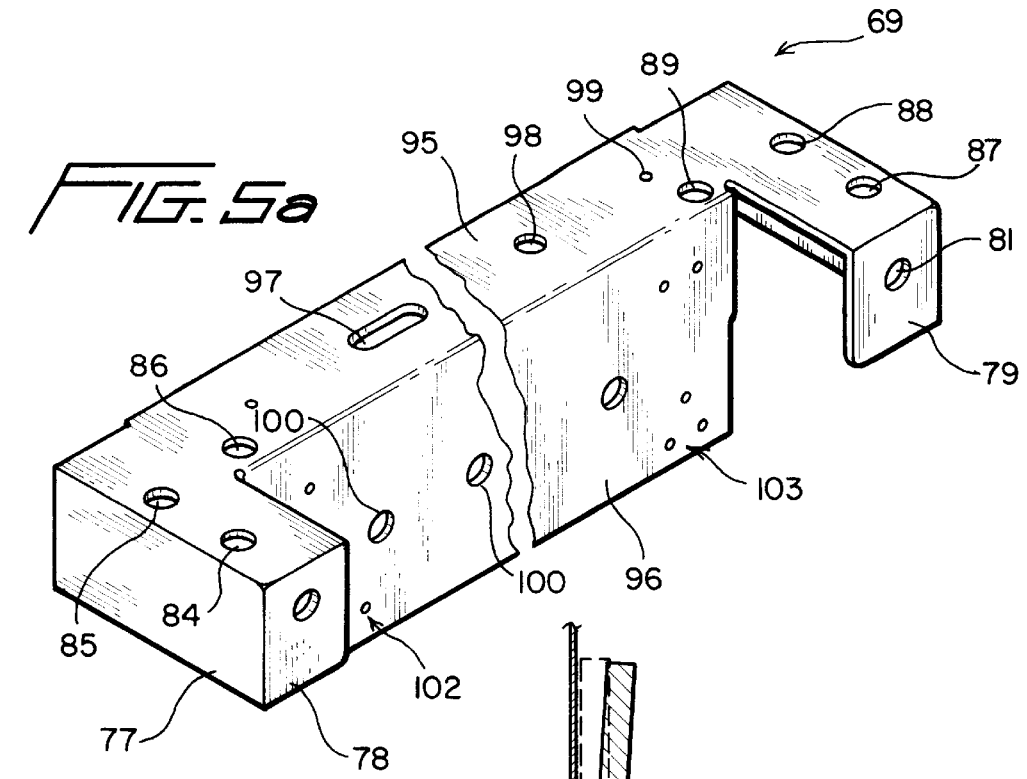
FIG. 5*a* is a perspective view of a cross member incorporated in the reinforcing frame of the invention.

As perhaps best shown in FIG. 5*a*, lower cross member 69 is generally L-shaped in central cross-section and includes a face portion 95 that is integrally formed with an in-turned portion 96. Face portion 95 includes a slot 97, a central hole 98 and various additional, transversely spaced holes 99. In addition, in-turned portion 96 is provided with various, transversely spaced holes 100. The holes 98 and 99 are also threaded in accordance with the preferred embodiment of the invention. Furthermore, the outer end sections of in-turned portion 96 is preferably formed with two, similarly arranged sets of holes 102 and 103.

Figure 6:
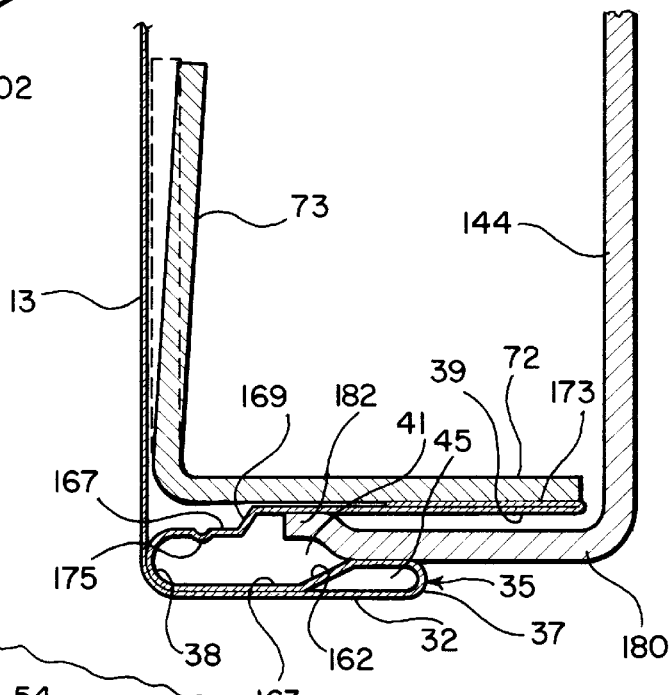
FIG. 6 is a cross-sectional view taken at a return flange area of the refrigerator cabinet assembly.

Lower cross member 69 is fixedly secured to side reinforcing members 64 and 65, such as through approximately one inch weld seams to front plate 72 and side plate 73. These welds are directly analogous to the welds preferably used to interconnect upper cross member 68 to front plate 72 and side plate 73 of each side reinforcing member 64, 65. As shown, first leg 95 is arranged in a common plane with the front plate 72 of each side reinforcing member 64, 65 (again refer to FIG. 1). However, in the preferred embodiment, side plates 73 are angled inward from the respective front plates 72 and legs 77 (also see the actual deflection of side plate 73 and the resulting acute angle with front plate 72 as best represented in FIG. 6). In addition, each side plate 73 is preferably provided with various bores 105. Although further details of reinforcing frame unit 7 will become more fully evident below, at this point, it should be recognized that reinforcing frame unit 7 is completely assembled so as to form an integrated structural reinforcing frame unit prior to being inserted within cabinet shell 5. Pre-assembling of reinforcing frame unit 7 with the various mounting holes, apertures and bores as described above enables refrigerator toe plate 9, door hinges, leg levelers and auxiliary wheel assemblies to be easily attached to the overall refrigerator cabinet 2 in a manner which will be detailed below.

As indicated above, toe plate 9 is preferably formed entirely of plastic. In accordance with the preferred embodiment, toe plate 9 includes a first front level surface portion 117 and a second front level surface portion 118. Second front level surface portion 118 is provided with numerous elongated slots 120–122, as well as triangularly arranged hole sets 124 and 125. As will be further outlined below, hole sets 124 and 125 are adapted to be aligned with through holes 84–86 and 87–89 respectively when refrigerator cabinet 2 is completely assembled. Toe plate 9 is also formed with side portions 127 and 128 that are adapted to project about side walls 13 and 14 when toe plate 9 is attached to cabinet shell 5.

Figure 4:
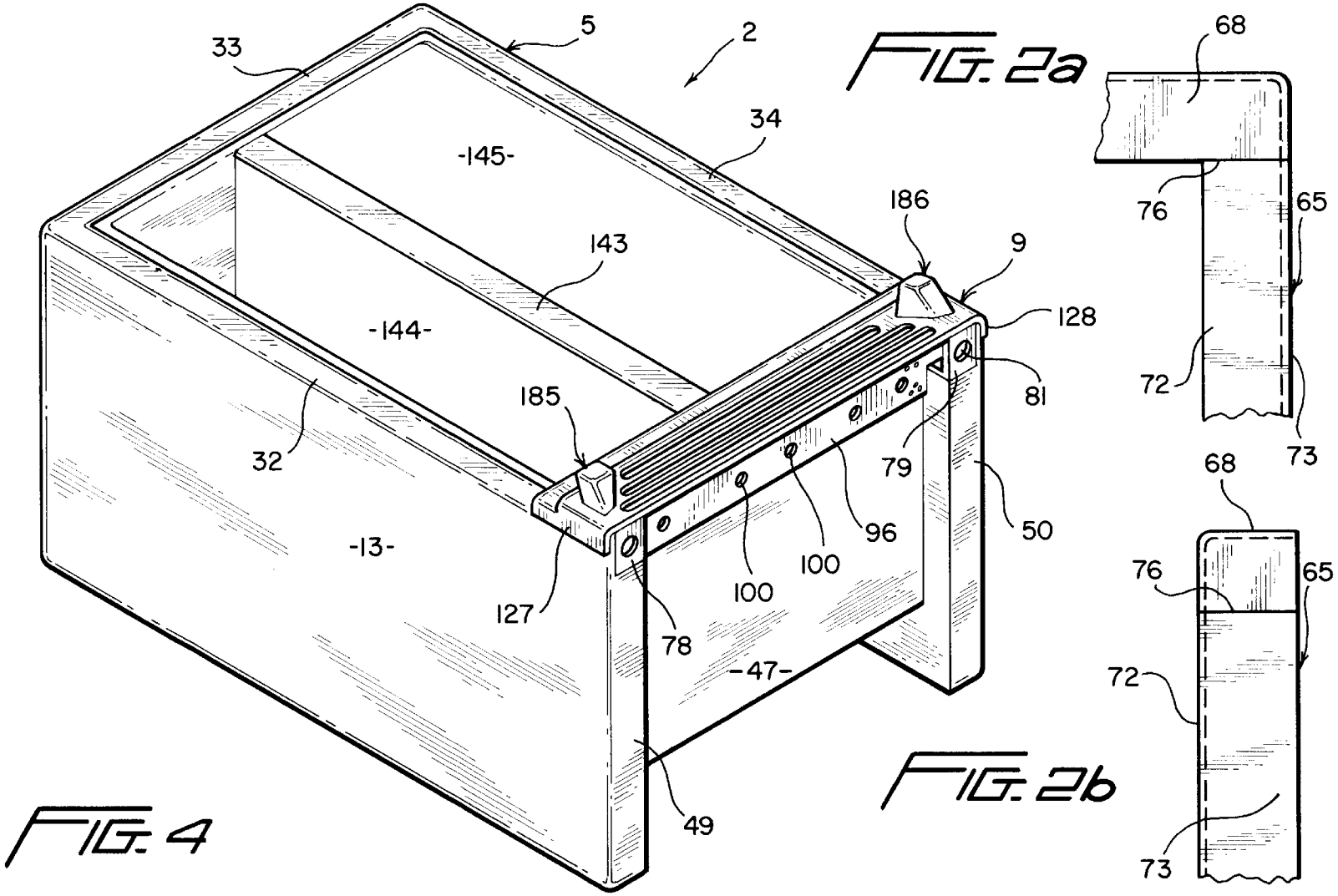
FIG. 4 shows the refrigerator cabinet assembly during a subsequent assembly stage.
Figure 3:
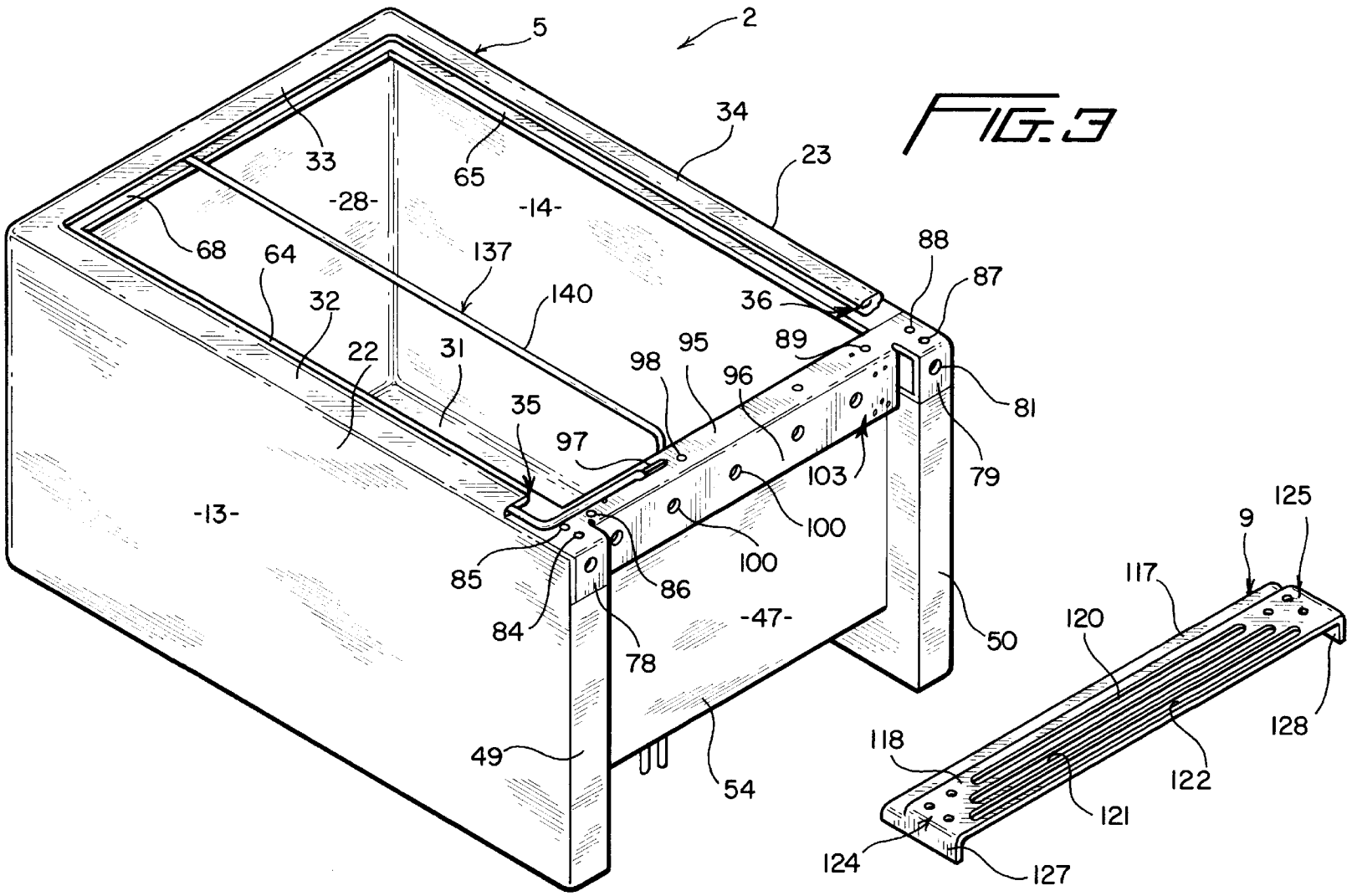
FIG. 3 is a partial exploded view of the refrigerator cabinet assembly.
Figure 5B:
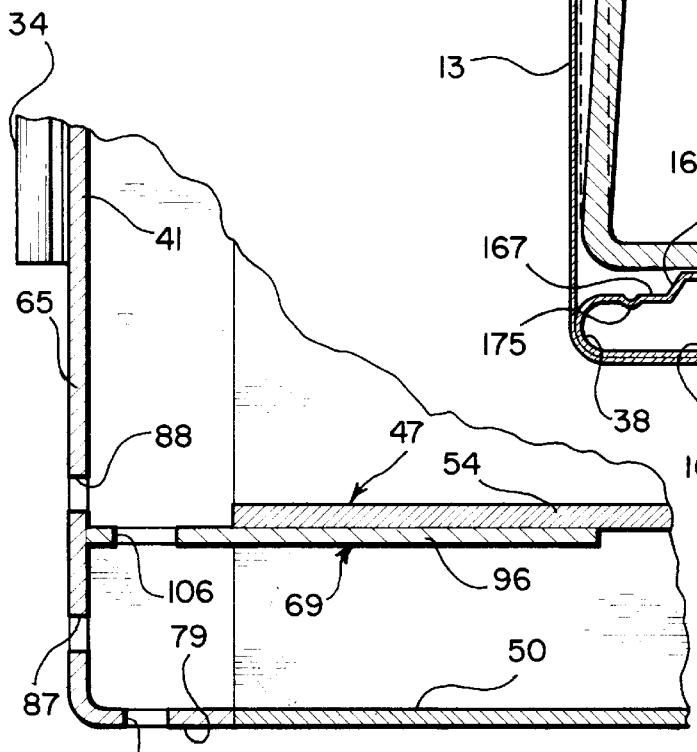
FIG. 5*b* is a cross-sectional view of the lower side corner of the refrigerator cabinet assembly.

With reference to FIGS. 1, 3 and 4 which depict refrigerator cabinet 2 during various stages of assembly, the manner in which cabinet shell 5, reinforcing frame unit 7 and toe plate 9 are united to form refrigerator cabinet 2 will now be explained. Once cabinet shell 5 and reinforcing frame unit 7 are individually constructed, reinforcing frame unit 7 is slid within receiving slot 58. Thereafter, reinforcing frame unit 7 is fixedly secured to cabinet shell 5, preferably along inner layer 39 of each of the return flanges 35, 36 associated with face portion 32–34. Although this attachment can be performed by various known methods, in accordance with the preferred embodiment, reinforcing frame unit 7 is preferably crimped or clinched to cabinet shell 5. FIG. 3 shows refrigerator cabinet 2 with reinforcing frame unit 7 and cabinet shell 5 united. Once united, front plates 72 of side reinforcing members 64 and 65 are arranged at the forwardmost portions 22 and 23 of side walls 13 and 14 and lower support members 78 and 79 are generally flush with horizontal leg defining sections 49 and 50 of shell bottom 47. As best shown in FIG. 5*b*, in-turned portion 96 of lower cross member 69 actually extends below horizontal central section 54 of shell bottom 47.

In accordance with the embodiment illustrated herein, refrigerator cabinet 2 defines a side-by-side refrigerator. Therefore, once reinforcing frame unit 7 is united with cabinet shell 5, a yoder tube 137 (see FIG. 3) is run through slot 97, along face portion 95 and then within return flange 35, as well as the return flange (not labeled) behind face portion 33. Then a section 140 of yoder tube 137 is arranged generally vertically adjacent the front of cabinet shell 5. As depicted in FIG. 4, once yoder tube 137 is run, a mullion 143 is positioned over section 140 of yoder tube 137, with an upper end of mullion 143 being secured at the return flange associated with face portion 33 in a manner known in the art and a lower end of mullion being secured at hole 98 with a mechanical fastener. Thereafter, respective freezer and fresh food liners 144 and 145 are positioned within refrigerator cabinet 2.

More specifically, as detailed in FIG. 6 with reference to the structure of return flange 35 and the mounting of freezer liner 144, return flange 35 includes a sloped section 162 that extends from inner curve section 37. Slope section 162 leads to a flat portion 163 that is pressed against front face portion 32. Flat portion 163 leads to roll-formed outer curved section 38, then to a generally straight section 167, a sloped section 169, an elongated inner layer 39 and a return layer 173. The generally straight section 167 is preferably dimpled such as indicated at 175 for use in holding yoder tube 137 in a desired position against outer curved section 38. Freezer liner 144 is formed with an annular, out-turned flange 180 having a terminal end 182 that is located in an offset plane. Freezer liner 144 is actually quite flexible so as to enable liner 144 to be positioned within refrigerator cabinet 2 and flexed until flange 180 is received within the respective portions of liner receiving cavity 41. In general, the liner receiving cavity 41 extends along three sides of liner 144 as either side of mullion 143 includes a similar return flange configuration in a manner known in the art. Therefore, in general, the manner in which liners 144 and 145 are mounted within cabinet assembly 142 is known in the art. However, forming return flanges 35 and 36 with elongated layers 39 and 173 greatly enhances the surface area to which reinforcing frame unit 7 can be attached and therefore is considered a beneficial aspect of the invention.

Once liners 144 and 145 are in place, toe plate 9 is attached by aligning hole sets 124 and 125 with through holes 84–86 and 87–89 respectively and then securing toe plate 9 to lower cross member 69 with threaded fasteners (not shown). Simultaneously, lower hinge units, generally indicated at 185 for the freezer section and 186 for the refrigerator section in FIG. 4, are secured at hole sets 124 and 125. When secured, side portions 127 and 128 of toe plate 9 extending about side walls 13 and 14 as clearly shown in FIG. 4. As indicated above, a lower end (not separately labeled) of mullion 143 is also preferably secured by attachment to lower cross member 69, such as by a screw or through another suitable mechanical connection. In addition, a magnetic strip, which is not shown or considered part of the present invention, is preferably secured to either face portion 95 at holes 99 or to first front level surface portion 117 of toe plate 9 to create a seal in combination with gaskets on the doors for cabinet 2. Lower hinge units 185 and 186 will actually cooperate with upper hinge units (not shown) that are secured atop refrigerator cabinet 2. Actually, top wall 28 is preferably formed with holes that are aligned with threaded apertures provided in upper cross member 68 for ease of attaching of the upper hinge units. Hole sets 102 and 103 enable wheel assemblies (not shown) to be easily fastened to a refrigerator cabinet 2 in a simple and convenient manner as well.

As is known in the art, refrigerator cabinet 2 is adapted to be insulated by the injection of foam between cabinet shell 5 and liners 144 and 145, as well as directly between liners 144 and 145 behind mullion 143. In the preferred embodiment of the present invention, insulation foam is injected through rear wall 31 and the zone to be filled with the foam is vented through transversely spaced holes 100 provided along in-turned portion 96 of lower cross member 69. During this process, some of the insulation foam will be forced through side plates 73 of side reinforcing members 64 and 65 at bores 105. Due to the angling of side plates 73 as discussed above and clearly shown in FIG. 6, the foam insulation will also flow between shell 5 and each side plate 73 to advantageously improve the structural integrity and overall thermal performance of refrigerator cabinet 2.

From the above description, it should be readily apparent that refrigerator cabinet 2 is provided with structural reinforcement at the front thereof where varying loads are imposed due to both the loading of doors pivotally attached thereto and the varying forces acting thereon when the loaded doors are swung open and closed repeatedly. In addition, the configuration of refrigerator cabinet 2 enables an extremely economical and efficient assembly process to be achieved, while also easing the attachment of final assembly elements including upper and lower hinges, leg levelers and wheel assemblies as described above. The configuration of toe plate 9 and the manner in which it is mounted, at least partially, over lower cross member 69 enables toe plate 9 to serve as both a face plate and a kick plate which further simplifies assembly of refrigerator cabinet 2, as well as reduces associated costs therewith. Although described with respect to a preferred embodiment of the invention, it should be readily understood that various changes and/or modifications may be made to the invention without departing from the spirit thereof. In general, the invention is only intended to be limited by the scope of the following claims.

We claim:

1. A refrigerator cabinet assembly comprising:

an outer cabinet shell including a pair of laterally spaced, upright side walls and a top wall interconnecting upper end portions of said side walls, said side and top walls including respective forwardmost portions;

an integrated structural reinforcing frame unit including a pair of spaced, elongated side reinforcing members that are interconnected by a pair of laterally extending cross members, said reinforcing frame unit being positioned and secured as a pre-assembled unit, within said cabinet shell, at the forwardmost portions of said side and top walls; and an upright mullion fixed to at least one of the cross members at a position located between said side reinforcing members.

2. The refrigerator cabinet assembly according to claim 1, further comprising return flanges extending inwardly from each of the forwardmost portions of said side and top walls, said reinforcing frame unit engaging to said return flanges.

3. The refrigerator cabinet assembly according to claim 1, wherein said reinforcing frame unit includes means for connecting refrigerator leveling members thereto.

4. The refrigerator cabinet assembly according to claim 3, wherein said reinforcing frame unit includes means for attaching wheel assemblies to said refrigerator cabinet assembly.

5. The refrigerator cabinet assembly according to claim 1, wherein each of the laterally extending cross members of said reinforcing frame unit is generally L-shaped in cross-section and interconnects said side reinforcing members directly at respective ends of said side reinforcing members.

6. A refrigerator cabinet assembly comprising:

an outer cabinet shell including a pair of laterally spaced, upright side walls and a top wall interconnecting upper end portions of said side walls, said side and top walls including respective forwardmost portions, said cabinet shell further including a shell bottom interconnecting lower end portions of said side walls and return flanges extending inwardly from each of the forwardmost portions of said side and top walls, said shell bottom being spaced rearward from the forwardmost portions of said side walls such that a receiving slot is defined between a front edge of said shell bottom and said return flanges; and an integrated structural reinforcing frame unit including a pair of spaced, elongated side reinforcing members that are interconnected by a pair of laterally extending cross members, said reinforcing frame unit being positioned and secured as a pre-assembled unit, within said receiving slot of said cabinet shell, at the forwardmost portions of said side and top walls.

7. The refrigerator cabinet assembly according to claim 6, wherein said side walls include lowermost portions, said return flanges including terminal ends spaced from the lowermost portions of said side walls.

8. The refrigerator cabinet assembly according to claim 7, further comprising a toe plate extending across said cabinet shell at the lowermost portions of said side walls.

9. The refrigerator cabinet assembly according to claim 8, wherein said toe plate includes side flanges which extend about the side walls of said cabinet shell.

10. The refrigerator cabinet assembly according to claim 8, wherein said toe plate is made of plastic.

11. The refrigerator cabinet assembly according to claim 8, wherein both said reinforcing frame unit and said toe plate include, prior to attachment to said cabinet shell, refrigerator door hinge mounting structure.

12. A refrigerator cabinet assembly comprising:

an outer cabinet shell including a pair of laterally spaced, upright side walls and a top wall interconnecting upper end portions of said side walls, said side and top walls including respective forwardmost portions;

an integrated structural reinforcing frame unit including a pair of spaced, elongated side reinforcing members that are interconnected by a pair of laterally extending cross members, wherein each of the side reinforcing members includes a front plate and a side plate; and means formed in each side plate for permitting a flow of foam insulation through the side plate and between the side walls of the outer cabinet shell and the side reinforcing members.

13. The refrigerator cabinet assembly according to claim 12, wherein the front plate and the side plate form an acute angle therebetween.

14. A method of constructing a refrigerator cabinet comprising:

preparing a cabinet shell including a pair of laterally spaced side walls that are interconnected by a top wall;

assembling an integrated reinforcing structural frame including a pair of spaced, elongated side reinforcing members that are interconnected by a pair of laterally extending cross members;

pre-forming said reinforcing frame with structure enabling refrigerator door hinges, levelers and wheel assemblies to be readily attached to said refrigerator cabinet;

positioning said reinforcing frame between forwardmost portions of said side and top walls within said cabinet shell; and securing the reinforcing structural frame to said cabinet shell.

15. The method according to claim 14, further comprising:

forming said cabinet shell with return flanges at the forwardmost portions of said side and top walls; and engaging said reinforcing structural frame and said cabinet shell at said return flanges.

16. A method of constructing a refrigerator cabinet comprising:

preparing a cabinet shell including a pair of laterally spaced side walls that are interconnected by a top wall and with return flanges at the forwardmost portions of said side and top walls;

providing a shell bottom that interconnects said side walls and is spaced rearward of said return flanges so as to form a receiving slot between a front edge of said shell bottom and said return flanges;

assembling an integrated reinforcing structural frame including a pair of spaced, elongated side reinforcing members that are interconnected by a pair of laterally extending cross members;

positioning said reinforcing frame between forwardmost portions of said side and top walls within said cabinet shell by sliding said reinforcing frame into said receiving slot; and engaging said reinforcing frame and said cabinet shell at said return flanges and securing the reinforcing frame to said cabinet shell.

17. The method according to claim 16, further comprising:

pre-forming said reinforcing frame with structure enabling refrigerator door hinges, levelers and wheel assemblies to be readily attached to said refrigerator cabinet.

18. A method of constructing a refrigerator cabinet comprising:

preparing a cabinet shell including a pair of laterally spaced side walls that are interconnected by a top wall, forming at least one bore in each side plate;

assembling an integrated reinforcing structural frame including a pair of spaced, elongated side reinforcing members that are interconnected by a pair of laterally extending cross members, while forming each of the side reinforcing members with a front plate and a side plate;

positioning said reinforcing frame between forwardmost portions of said side and top walls within said cabinet shell;

securing the reinforcing structural frame to said cabinet shell; and injecting foam insulation into the cabinet shell, with the foam insulation flowing between the side walls of the cabinet shell and the side reinforcing members through the at least one bore in each side plate.

19. The method according to claim 18, further comprising:

forming an acute angle between the front and side plates of each of the side reinforcing members.

* * * * *